United States Patent [19]

Allison et al.

[11] 3,952,409

[45] Apr. 27, 1976

[54] METHOD OF MANUFACTURE OF ELECTRIC HEATING ASSEMBLY

[75] Inventors: William L. Allison, Strawberry Plains; Donald E. Alexander, Knoxville, both of Tenn.

[73] Assignee: Carrier Corporation, Syracuse, N.Y.

[22] Filed: June 30, 1975

[21] Appl. No.: 591,976

[52] U.S. Cl. ..... 29/611; 29/417; 29/513; 113/116 HH; 219/532; 338/317

[51] Int. Cl.[2] ..... H05B 3/00

[58] Field of Search ..... 29/611, 430, 417, 513, 29/521; 219/532; 338/315, 317, 318; 113/1 N, 116 CC, 116 HH

[56] References Cited

UNITED STATES PATENTS

| | | | |
|---|---|---|---|
| 1,493,386 | 5/1924 | Rice | 219/532 |
| 1,801,191 | 4/1931 | Cuffe | 219/532 |
| 2,226,781 | 12/1940 | Rutenber | 338/317 X |
| 3,770,939 | 11/1973 | Kokjohn | 219/532 |
| 3,846,619 | 11/1974 | Wightman et al. | 219/532 |
| 3,851,147 | 11/1974 | Hachmeister | 219/532 X |
| 3,869,789 | 3/1975 | Yungblut et al. | 29/513 X |
| 3,883,721 | 5/1975 | Paulson et al. | 338/317 X |

*Primary Examiner*—Victor A. DiPalma
*Attorney, Agent, or Firm*—J. Raymond Curtin; Barry E. Deutsch

[57] ABSTRACT

A method of manufacturing a support structure for an electric heating assembly from a single piece of metal. The piece of metal is advanced progressively through a plurality of work stations. At a first station, excess material is removed from the piece of metal to provide a strip of metal extending transversely between second and third strips of metal. At a next station, the transversely extending strip is formed into a channel-like member. Thereafter, insulators to mount the heating element are loaded onto the channel-like member. The second and third strips of metal are bent at right angles to the first strip to provide integral side supports for the support structure of the assembly.

3 Claims, 7 Drawing Figures

METHOD OF MANUFACTURE OF ELECTRIC HEATING ASSEMBLY

BACKGROUND OF THE INVENTION

This invention relates in general to electric heating assemblies and more particularly, to support structures for the elements of the assembly and to the method of manufacturing such support structures.

Electric heating assemblies of the type having a resistance element connected to a source of electricity and mounted on suitable support structure including insulating members are used in various applications. Such assemblies may be used independently, for example to provide heat for a space or a room. Alternatively, such assemblies may be incorporated into a larger piece of equipment; for example, resistance heaters can be employed in air conditioning units to provide warm air when required.

One known method of producing heating assemblies of the foregoing type has involved advancing a piece of sheet metal through a plurality of work stations. At a first station, excess material is removed from the sheet metal to provide first strips of metal extending transversely to the direction of advance of the piece of metal. The first strips remain connected at their outer ends to second and third strips of metal extending parallel to the direction of advance of the material. The second and third strips of metal have holes punched therethrough for engagement by indexing means used to advance the sheet of metal progressively through various work stations.

At a second work station, the first strips are bent to form channel-like members. At a next station, insulating blocks are inserted into the channel-like members. The insulators are employed for mounting the resistance elements on the support structure.

Thereafter, the second and third strips of metal are removed in a manner leaving tabs extending outwardly from each end of the first strips. At a subsequent work station, side supports are connected to the support structure heretofore formed for the purposes of increased rigidity. The side supports have holes formed therethrough to receive the tabs extending outwardly from the ends of the first strips. After the tabs are inserted into the openings, the tabs are crimped to permanently connect the side supports to the first strips to thereby provide a finished support structure for the heating assembly.

In order to decrease the cost of manufacturing and providing the assembly, an improved support structure and method of manufacturing same is provided.

SUMMARY OF THE INVENTION

It is an object of this invention to reduce the manufacturing costs of electric heating assemblies.

It is another object of this invention to reduce the cost of manufacturing a support structure for the heating elements of this assembly.

It is a further object of this invention to form a support structure from a single piece of material without decreasing the structural strength of such member.

These and other objects of the present invention are attained by means of a method of manufacturing a support structure for the heating elements of an electric heating assembly comprising the steps of advancing a piece of metal through a plurality of work stations. At a first station, excess material is removed from the piece of metal to provide a first strip of metal extending transversely between second and third strips of metal. At a next station, the first strip is bent to form a channel-like member. Thereafter, insulators are loaded onto the channel-like member. Thence, the second and third strips are bent at right angles to the first strip to form integral side supports for the support structure of the heating assembly.

DESCRIPTION OF THE PREFERRED EMBODIMENT

Figures 1, 2, 3, 4, 5, 6:
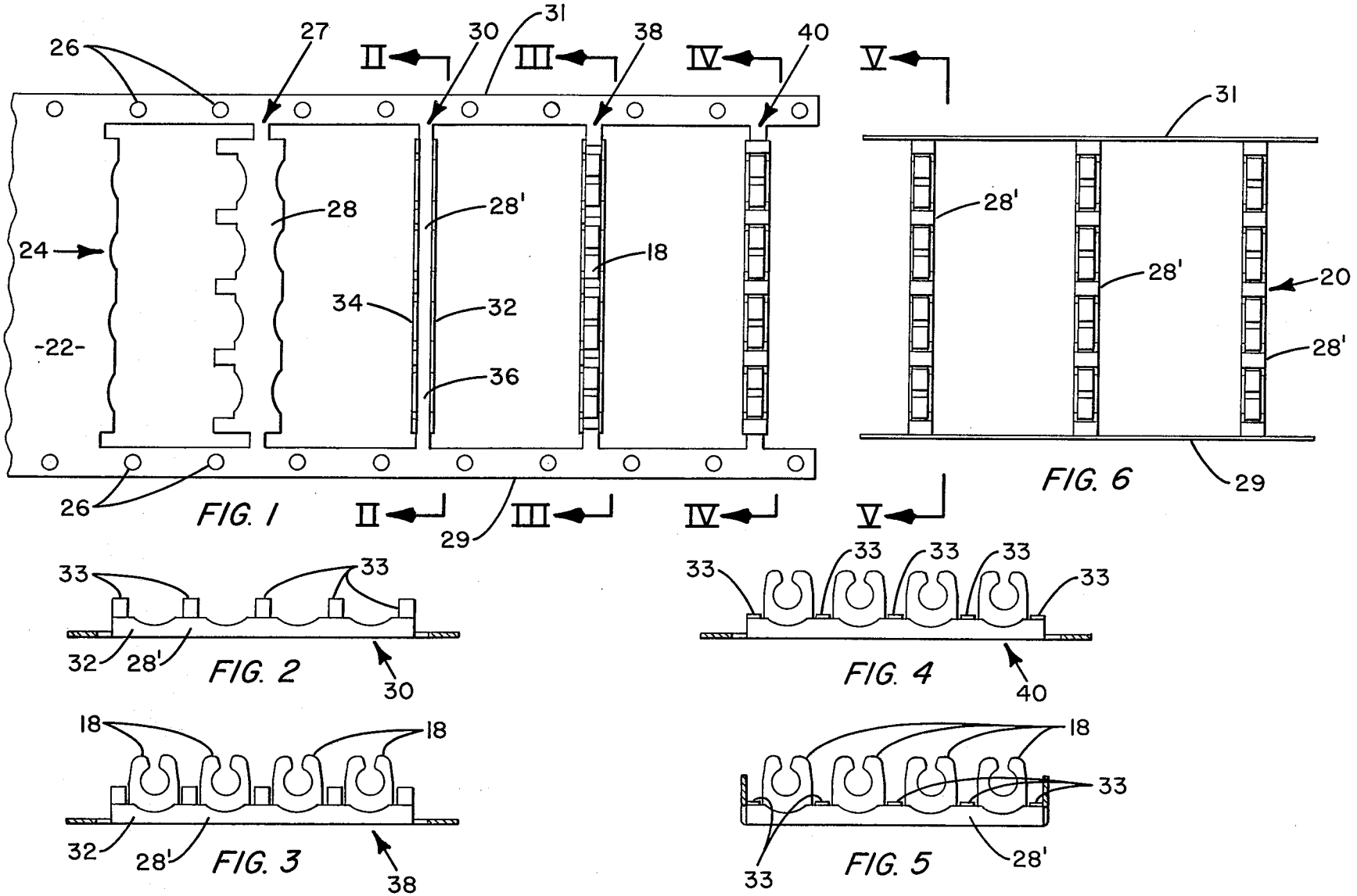
FIG. 1 is a schematic representation illustrating a preferred method of forming the support structure for electric heating assemblies.
FIG. 2 is a sectional view taken along line II—II of FIG. 1.
FIG. 3 is a sectional view taken along line III—III of FIG. 1.
FIG. 4 is a sectional view taken along line IV—IV of FIG. 1.
FIG. 5 is a sectional view taken along line V—V of FIG. 6.
FIG. 6 is a top plan view of the support structure of the instant invention.

Referring now to the drawings, there is illustrated a preferred embodiment of the instant invention. In referring to the various figures of the drawings, like numerals shall refer to like parts.

Figure 7:
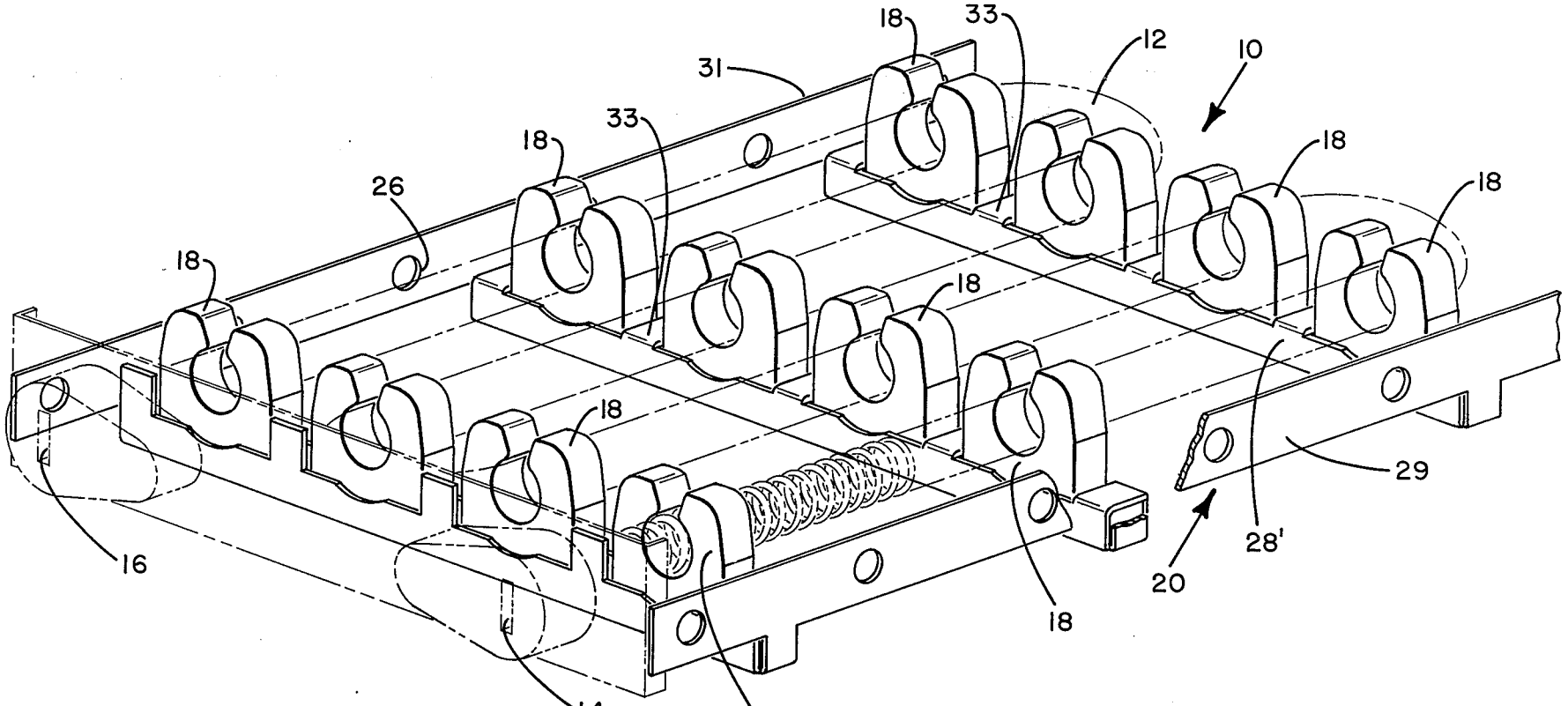
FIG. 7 is a perspective view of an electric heating element assembly including the invention herein disclosed.

With particular reference to FIG. 7, there is disclosed a completed electric heating element assembly 10 of the type to which the present invention pertains. Assembly 10 includes electric resistance element 12 (shown in phantom). Element 12 may be formed from a single piece of material and bent to provide a plurality of U-shaped sections. Element 12 is suitably connected to a source of electricity via connecting means 14 and 16. The element is supported by a plurality of insulating blocks 18. Blocks 18 are formed from suitable nonconductive material. The blocks and thus element 12 are supported by support structure 20. The details of support structure 20 and the method of manufacture thereof shall now be explained more fully.

With particular reference to FIG. 1, there is disclosed a plan view illustrating successive changes affected along an advancing piece of sheet metal 22 during the process of manufacturing suppport structure 20. The sheet metal piece illustrated in FIG. 2 is moving from the left towards the right as indicated by arrow 24. The piece of sheet metal includes a plurality of holes 26 provided along either edge thereof. The holes are provided for engagement by an indexing mechanism (not shown) employed to advance the piece of sheet metal from one work station to the next.

At a first station 27, excess material is removed via a stamping or similar process to form first strips of metal 28 extending transversely to the axis of advance of the sheet metal piece. First strips 28 are provided in axial spaced apart relation.

The removal of the excess material also provides second and third strips of metal 29 and 31. The second and third strips include indexing holes 26, and extend generally parallel to the direction of advance of sheet metal piece 22. The second and third strips are attached to first strips 28 at the outer ends of each of the first strips.

At a second station 30, strips 28 are bent or otherwise formed to provide channel-like members 28'. The channel-like members include upstanding walls 32 and 34 connected at the bottom by bottom wall 36. As is illustrated in FIG. 2, preferably tabs 33 extend vertically upwardly from one of the walls.

At a next station 38, insulating blocks 18 are inserted between the opposed walls of channel-like members 28'. As noted previously, members 18 are subsequently employed as a support and connecting means for resistance element 12.

At the next work station 40, the tabs of the channel-like members 28' are bent downwardly to firmly lock the insulating members in place. As illustrated in FIGS. 4, 5 and 7, consecutive ones of the tabs capture an insulating block therebetween. The utilization of the tabs in the foregoing manner is more fully described in co-pending application, Ser. No. 591,798, filed June 30, 1975. Thereafter, when a desired number of rows of insulating blocks have been obtained, the portion of the piece of sheet metal bearing the desired number of rows of insulating blocks is separated or severed from the remaining portion of sheet metal.

As is illustrated in FIG. 6, wherein a support surface having three rows of insulating blocks is provided, second and third strips of sheet metal 29 and 31 having indexing holes 26 are bent at substantially a 90° angle to the first strips to provide integral side support members. Such side support members increase the rigidity and structural strength of support structure 20. Thereafter, the resistance element 12 is installed in the desired manner on insulating blocks 18.

By employing the second and third strips of metal which have been previously discarded in prior methods of manufacture, a reduction in the cost of manufacturing is obtained. It is thus no longer necessary to provide separate side support members and in addition, a crimping step heretofore required to attach the side support members to the transversely extending first strips may be eliminated. Thus, a significant reduction in manufacturing costs for the heating assembly is obtained without decreasing the quality of the final product.

While a preferred embodiment of the present invention has been described and illustrated, the invention should not be limited thereto, but may be otherwise embodied within the scope of the following claims.

We claim:

1. The method of forming a support structure for an electric heating element assembly by advancing a piece of sheet metal through a plurality of work stations comprising the steps of:

removing portions of excess material from said piece of sheet metal to provide first strips of sheet metal extending transversely between second and third strips of metal extending in transversely between second and third strips of metal extending in the direction of advance of said piece of sheet metal and lying substantially in a horizontal plane;

bending the transversely extending first strips of metal to form channel-like sections for receiving insulators to support the electric heating elements of the assembly;

loading the insulators onto the channel-like sections; and bending the second and third strips of metal substantially at right angles to said first strips to provide integral side supports for the support structure of said assembly.

2. The method in accordance with claim 1 wherein said electric heating element is mounted on the insulators subsequent to the forming of the side supports of said support structure.

3. The method in accordance with claim 2 wherein a portion of the piece of sheet metal is severed from the remaining piece of metal subsequent to mounting insulators on a predetermined number of channel-like members.

* * * * *